US010198982B2

(12) United States Patent
Mizuno

(10) Patent No.: US 10,198,982 B2
(45) Date of Patent: Feb. 5, 2019

(54) IMAGE PROCESSING APPARATUS, METHOD THEREOF, AND IMAGE DISPLAY APPARATUS

(71) Applicant: CANON KABUSHIKI KAISHA, Tokyo (JP)

(72) Inventor: Ryosuke Mizuno, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 59 days.

(21) Appl. No.: 15/074,340

(22) Filed: Mar. 18, 2016

(65) Prior Publication Data

US 2016/0284260 A1 Sep. 29, 2016

(30) Foreign Application Priority Data

Mar. 23, 2015 (JP) ..... 2015-060019

(51) Int. Cl.
*G09G 3/20* (2006.01)
*G09G 3/36* (2006.01)
*G09G 3/34* (2006.01)

(52) U.S. Cl.
CPC ..... *G09G 3/2003* (2013.01); *G09G 3/2022* (2013.01); *G09G 3/3648* (2013.01); *G09G 3/2025* (2013.01); *G09G 3/346* (2013.01); *G09G 2320/0233* (2013.01); *G09G 2320/0242* (2013.01); *G09G 2320/0261* (2013.01); (Continued)

(58) Field of Classification Search
CPC ..... G09G 3/36; G09G 3/2022; G09G 2320/0242; G09G 2320/064; G09G 3/2003; G09G 3/3648; G09G 3/2025; G09G 3/346; G09G 2340/16; G09G 2320/0233; G09G 2320/0261; G09G 2320/0285; G09G 2340/0435; G09G 2320/0271
See application file for complete search history.

(56) References Cited

U.S. PATENT DOCUMENTS 6,683,982 B1 * 1/2004 Kohn ..... H04N 9/11 348/E9.009
2006/0055830 A1 * 3/2006 Sakashita ..... H04N 5/74 348/678
(Continued)

FOREIGN PATENT DOCUMENTS

JP H04-302289 A 10/1992
JP 11-126050 A 5/1999
(Continued)

OTHER PUBLICATIONS

Japanese office action issued in corresponding Japanese application No. 2015-060019 dated Dec. 10, 2018, with English translation, 5 pages.

*Primary Examiner* — Md Saiful A Siddiqui
(74) *Attorney, Agent, or Firm* — Carter, DeLuca, Farrell & Schmidt, LLP

(57) ABSTRACT

A plurality of sub-frame images are generated from an input frame image. Lightness of one or more sub-frame image included in the plurality of sub-frame images is adjusted to generate a light image and a dark image. Color-non-uniformity correction processing is performed on the light image and the dark image to reduce color non-uniformity of a display device using a correction value in accordance with an adjustment degree of the lightness.

18 Claims, 5 Drawing Sheets

(52) U.S. Cl.
CPC ..... *G09G 2320/0285* (2013.01); *G09G 2340/0435* (2013.01); *G09G 2340/16* (2013.01)

(56) References Cited

U.S. PATENT DOCUMENTS

| | | | | |
|---|---|---|---|---|
| 2008/0062162 | A1* | 3/2008 | Mamba | G09G 3/3648 345/213 |
| 2012/0293571 | A1* | 11/2012 | Gotoh | G09G 3/3413 345/690 |
| 2013/0050248 | A1* | 2/2013 | Nose | G09G 3/2003 345/596 |
| 2017/0018105 | A1* | 1/2017 | Hasegawa | H04N 1/407 |

FOREIGN PATENT DOCUMENTS

| | | | |
|---|---|---|---|
| JP | 2001357394 | A | 12/2001 |
| JP | 2008046371 | A | 2/2008 |
| JP | 2009244717 | A | 10/2009 |
| JP | 2010055111 | A | 3/2010 |
| JP | 2011209514 | A | 10/2011 |
| JP | 2012013787 | A | 1/2012 |
| JP | 2013019936 | A | 1/2013 |

* cited by examiner

IMAGE PROCESSING APPARATUS, METHOD THEREOF, AND IMAGE DISPLAY APPARATUS

BACKGROUND OF THE INVENTION

Field of the Invention

The present invention relates to image processing for a display device.

Description of the Related Art

Image display apparatuses provided with various display devices such as a liquid crystal panel, in particular, monitors for television receivers and personal computers have been put to practical use. There exist techniques of correcting various characteristics of these display devices to display images.

For example, in a liquid crystal panel, the transmissivity or reflectance may change depending on the position on the liquid crystal panel surface, and color non-uniformity may visually be recognized accordingly. To reduce the color non-uniformity, color-non-uniformity correction processing is performed. The color-non-uniformity correction processing is processing of preparing color-non-uniformity correction values corresponding to image signal levels and positions on the liquid crystal panel surface in advance, and generating a signal (to be referred to as a "liquid crystal panel driving signal" hereinafter) used to drive the liquid crystal panel using a color-non-uniformity correction value corresponding to an input image signal.

Japanese Patent Laid-Open No. 2001-357394 discloses a technique of decreasing the data amount of color-non-uniformity correction values. That is, a reference color-non-uniformity correction value corresponding to a certain image signal level is stored. For other image signal levels, difference values from the reference color-non-uniformity correction value are stored, thereby decreasing the data amount of color-non-uniformity correction values.

After the signal level of the liquid crystal panel driving signal is changed, a certain time is needed until the signal level of the liquid crystal panel driving signal actually reaches a desired signal level. This time is called a "response speed." There exist liquid crystal panels whose response speeds are not sufficiently high. In addition, since the response speed changes in accordance with the transition of the signal level between frames, problems such as afterimage generation and color change in moving image display remain.

To improve the response speed of a liquid crystal panel, there has been proposed so-called overdrive correction processing of comparing an image signal displayed in the preceding frame with an image signal to be displayed in the next frame and correcting the liquid crystal panel driving signal in accordance with the comparison result (Japanese Patent Laid-Open No. 04-302289).

When tracking a moving object displayed on a hold-type liquid crystal panel (to be referred to as "tracking sight" hereinafter), a motion blur according to the light output period is observed. There has been proposed a technique of doubling the frame rate of an input image signal (for example, from 60 Hz to 120 Hz) to generate subframes (frame rate doubling) and outputting one subframe image as a black image or dark image. According to this technique, the light output period of the hold-type liquid crystal panel is shortened, and the motion blur can be reduced. In, for example, Japanese Patent Laid-Open No. 11-126050 (literature 3), the continuous light-emitting period or effective light-emitting period is limited from at least 30% to not more than 70% between subframes, thereby reducing the motion blur or afterimage that makes the motion of an object unnatural.

According to the technique disclosed in literature 3, display with a light/dark difference being given between subframes is performed (to be referred to as "light and dark display" hereinafter), thereby reducing unnaturalness of a motion of an object. On the other hand, since the signal level changes between the subframes of a single frame, the influence of the response speed of the liquid crystal panel readily becomes large as compared to a case in which only frame rate doubling is performed.

According to color-non-uniformity correction processing, even if image signals have the same signal level, liquid crystal panel driving signals of different signal levels are generated in accordance with positions on the liquid crystal panel surface. For this reason, when light and dark display and color-non-uniformity correction processing are combined, the influence of the response speed changes depending on the position on the liquid crystal panel surface. Hence, appropriate color-non-uniformity correction processing may be impeded by the influence of the response speed, and color non-uniformity may be observed. Although the color non-uniformity can be reduced by reducing the influence of the response speed by overdrive correction processing, as a matter of course, a frame memory for storing the image signal of the preceding frame is necessary, and the memory amount increases.

SUMMARY OF THE INVENTION

In one aspect, an image processing apparatus for outputting an image to a display device, the apparatus comprising: a first generation unit configured to generate a plurality of sub-frame images from an input frame image; a second generation unit configured to adjust lightness of one or more sub-frame image included in the plurality of sub-frame images to generate a light image and a dark image; and a correction unit configured to perform color-non-uniformity correction processing on the light image and the dark image to reduce color non-uniformity of the display device using a correction value in accordance with an adjustment degree of the lightness in the second generation unit.

According to the aspect, it is possible to reduce color non-uniformity caused by the response speed while reducing unnaturalness of a motion of an object on a display apparatus.

Further features of the present invention will become apparent from the following description of exemplary embodiments with reference to the attached drawings.

DESCRIPTION OF THE EMBODIMENTS

Hereinafter, image processing apparatuses, image processing methods, and image display apparatuses according to the embodiments of the present invention will be described in detail with reference to the accompanying drawings. It should be noted that the following embodiments are not intended to limit the scope of the appended claims, and that not all the combinations of features described in the embodiments are necessarily essential to the solution of the present invention.

First Embodiment

Arrangement of Apparatus

Figure 1:
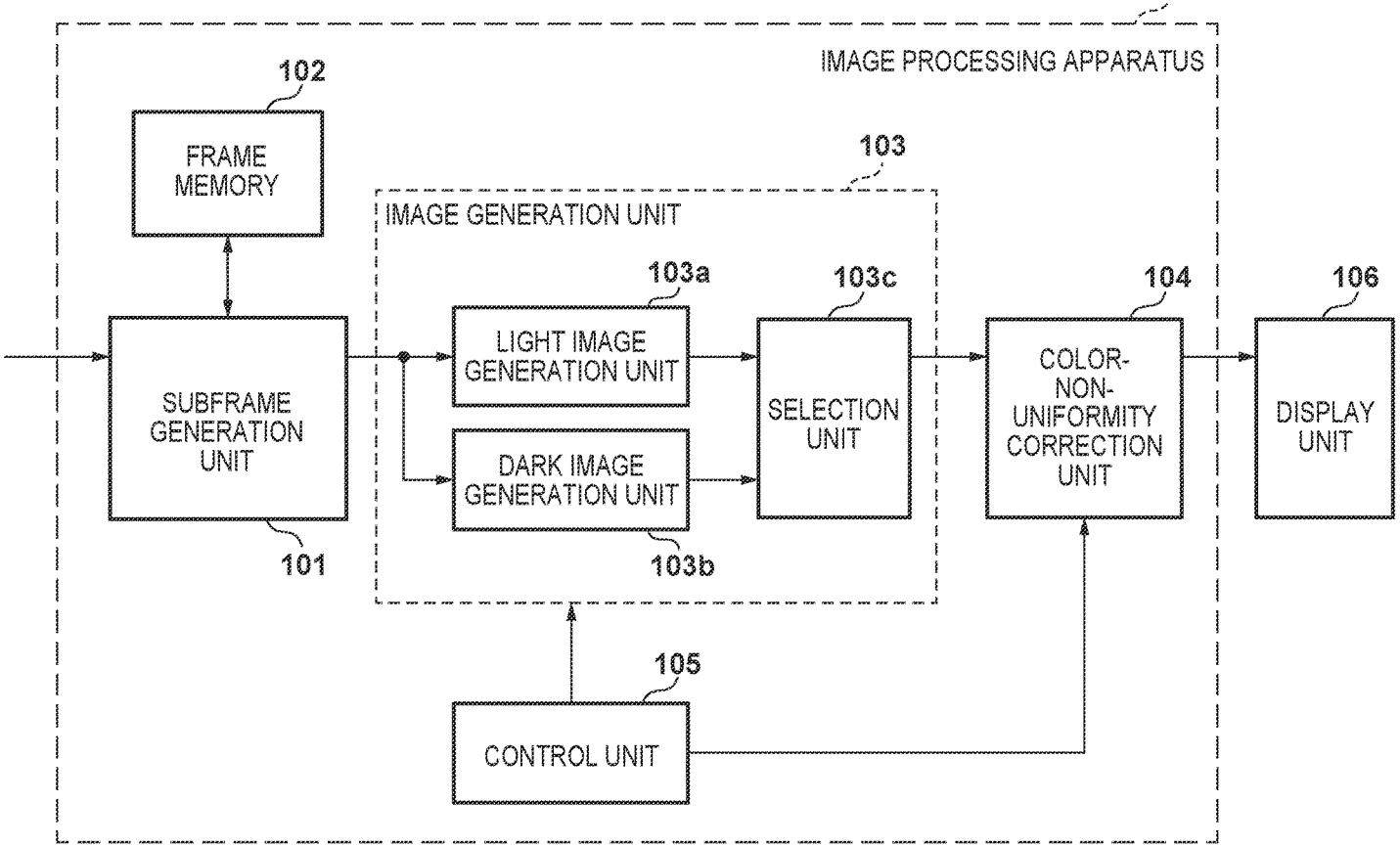
FIG. 1 is a block diagram showing the arrangement of an image display apparatus including an image processing apparatus according to the first embodiment.

An image processing apparatus according to this embodiment generates two subframe images from each frame image input for each frame, and sequentially outputs the two subframe images in one frame period, thereby obtaining an output frame rate twice higher than the input frame rate (frame rate doubling). At this time, light and dark display is performed between the subframes, and color-non-uniformity correction processing of a display image is performed. The block diagram of FIG. 1 shows the arrangement of an image display apparatus including an image processing apparatus 100 according to the first embodiment.

A subframe generation unit 101 stores each input frame image in a frame memory 102, and reads out the image from the frame memory 102 at a frame rate twice higher than the input frame rate. A first subframe image SF[i] and a second subframe image SF[i+1] are thus generated.

An image generation unit 103 includes a light image generation unit 103*a* and/or a dark image generation unit 103*b*, and adjusts the lightness of each subframe image to reduce a motion blur. The image generation unit 103 alternately outputs, for example, a light image generated from the first subframe image SF[i] and a dark image generated from the second subframe image SF[i+1] by a selection unit 103*c*.

The image generation unit 103, for example, multiplies each of the RGB levels of the input image by a predetermined ratio (gain amount), thereby adjusting the signal level. A gain amount Ga of the first subframe image SF[i] is preferably adjustable within the range of, for example, 120% (1.2) to 50% (0.5). A gain amount Gb of the second subframe image SF[i+1] is preferably adjustable within the range of 100% (1.0) to 0% (0.0), and is not more than the gain amount Ga (Gb≤Ga).

Note that the lightness adjustment method is not limited to the method of multiplying RGB levels by gain amounts. A method of separating the image signal into a brightness value Y and color components Cb and Cr and multiplying the brightness value Y by a gain amount may be used. Also usable is a method of multiplying some signal levels by gain amounts. The lightness of each of RGB components may nonlinearly be adjusted using a lookup table or the like.

An example in which an output frame rate twice higher than the input frame rate is obtained has been described above. However, an output frame rate three or more times higher may be obtained, and a plurality of subframe images may be generated. In this case, a light image is generated from at least one subframe image included in the plurality of subframe images, and a dark image is generated from the remaining subframe images. If there are three or more subframe images, the light image or the dark image is selectively output, instead of alternately outputting the light image and the dark image.

A color-non-uniformity correction unit 104, which will be described later in detail, corrects the image signal level in accordance with the input image signal level and the position on the liquid crystal panel surface to reduce color non-uniformity of the display image. A display unit 106 includes a hold-type display device (for example, liquid crystal panel). The display unit 106 generates a display device driving signal from the subframe images after color-non-uniformity correction output from the color-non-uniformity correction unit 104, and displays an image on the display device.

A control unit 105, which will be described later in detail, controls the gain amounts to be used by the image generation unit 103 and the color-non-uniformity correction values to be used by the color-non-uniformity correction unit 104. The control unit 105 is constituted using, for example, one-chip microprocessor which has at least a microprocessor (CPU), a random access memory (RAM), and a read-only memory (ROM). The CPU executes a program stored in the ROM using the RAM as a work memory to control processing will be described later.

Color-Non-Uniformity Correction Processing

Figure 2:
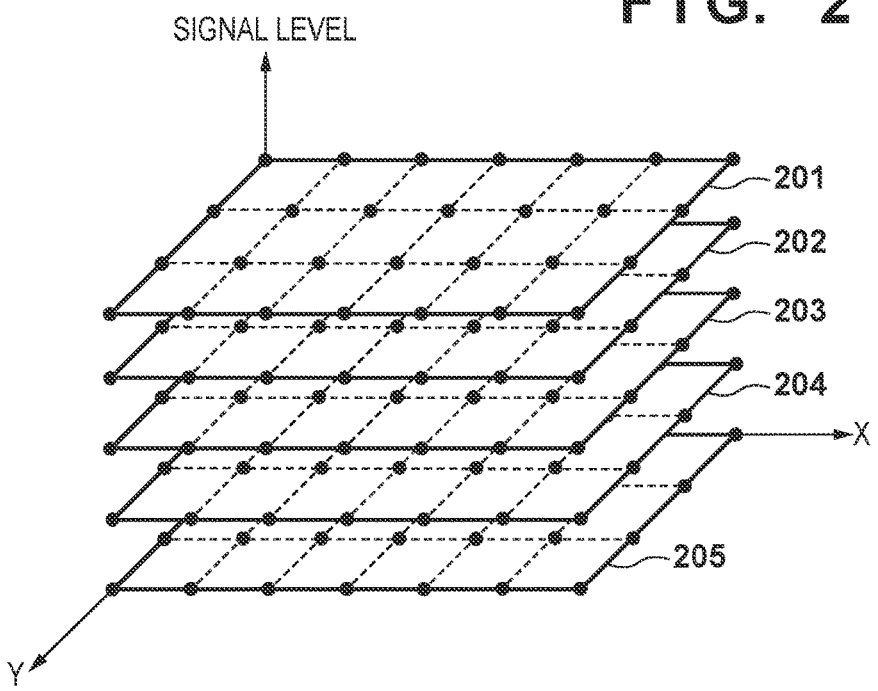
FIG. 2 is a view for explaining color-non-uniformity correction values used in color-non-uniformity correction processing.

Color-non-uniformity correction values used in color-non-uniformity correction processing will be described with reference to FIG. 2. FIG. 2 shows an example of the arrangement of color-non-uniformity correction values, in which the ordinate represents an image signal level, the X-axis represents a horizontal pixel coordinate of the liquid crystal panel surface, and the Y-axis represents a vertical pixel coordinate of the liquid crystal panel surface. Note that the color-non-uniformity correction processing is performed for each of RGB colors, and will be described below as processing common to RGB.

Color-non-uniformity correction values are set as, for example, a table (to be referred to as a "color-non-uniformity correction table" hereinafter) with a 3D lookup table format stored in correspondence with coordinates sampled in the horizontal and vertical directions for each of a plurality of reference image signal levels 201 to 205. A color-non-uniformity correction value is generated so as to reduce color non-uniformity of a display image based on, for example, a result obtained by measuring or capturing an image displayed on the liquid crystal panel by an image signal of a predetermined signal level.

The color-non-uniformity correction unit 104 refers to the color-non-uniformity correction table and acquires a color-non-uniformity correction value corresponding to the signal level and coordinates of a pixel of interest. At this time, the color-non-uniformity correction value of the pixel of interest is calculated by interpolation processing using the color-non-uniformity correction values of a plurality of lattice points (for example, four lattice points, six lattice points, or eight lattice points) surrounding the signal level and coordinates of the pixel of interest. The color-non-uniformity correction unit 104 adds the acquired color-non-uniformity correction value to the signal level of the pixel of interest, thereby obtaining the signal level of the pixel of interest after color-non-uniformity correction processing.

Control of Gain Amounts and Correction Values

Figure 3:
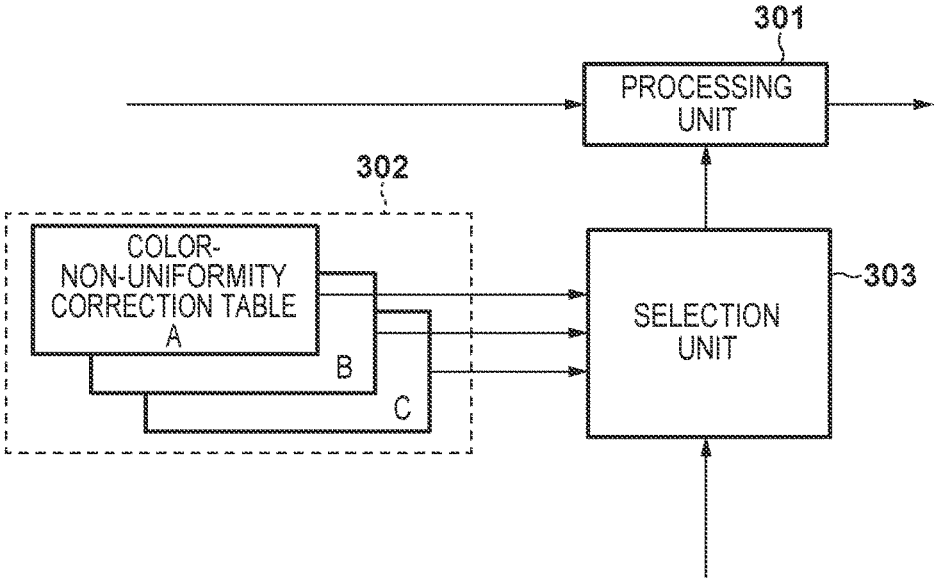
FIG. 3 is a block diagram showing the arrangement of a color-non-uniformity correction unit.

The block diagram of FIG. 3 shows the arrangement of the color-non-uniformity correction unit 104. A storage unit 302 stores a plurality of color-non-uniformity correction tables. A selection unit 303 selects a color-non-uniformity correction table based on an instruction from the control unit 105, and supplies the selected color-non-uniformity correction table to a processing unit 301. The processing unit 301 executes the above-described color-non-uniformity correction processing using the selected color-non-uniformity correction table. FIG. 3 shows an example in which the storage unit 302 stores three color-non-uniformity correction tables which will be referred to as tables A, B, and C hereinafter. Note that the number of correction tables can be arbitrary as long as there are at least two correction tables.

Assume that the gain amount Ga of the image generation unit 103 is 100%, and the gain amount Gb changes within the range of 0% to 100%. In this case, the table A is a color-non-uniformity correction table generated so as to reduce color non-uniformity of a display image under settings of, for example, Ga=100% and Gb=100%. The table B is a color-non-uniformity correction table generated so as to reduce color non-uniformity of a display image under settings of, for example, Ga=100% and Gb=50%. The table C is a color-non-uniformity correction table generated so as to reduce color non-uniformity of a display image when, for example, Ga=100% and Gb=0% are set.

The tables A, B, and C are generated from a result obtained by measuring or capturing an image displayed on the liquid crystal panel of the display unit 106 based on an image signal of a predetermined signal level supplied to the image processing apparatus 100 with the above-described gain amounts being set such that color non-uniformity of a display image is reduced.

The control unit 105 outputs a signal to select one of the tables A, B, and C in accordance with the gain amount Gb. For example, when the gain amount Gb falls within the range of 100% to 75%, a control signal to select the table A is output. Within the range of 75% to 25%, a control signal to select the table B is output. Within the range of 25% to 0%, a control signal to select the table C is output.

Alternatively, a color-non-uniformity correction value calculated by interpolating color-non-uniformity correction values in a plurality of tables may be used. For example, when Gb=100%, the processing unit 301 selectively uses the table A. When Gb=50%, the processing unit 301 selectively uses the table B. For an intermediate value (100%<Gb<50%), the tables A and B are selected. The processing unit 301 acquires the color-non-uniformity correction values of lattice points (for example, four lattice points in each table) surrounding the pixel of interest from these tables. Corresponding color-non-uniformity correction values are weighted by the value Gb and averaged to calculate, for example, four color-non-uniformity correction values. The color-non-uniformity correction value of the pixel of interest is calculated by an interpolation operation using the color-non-uniformity correction values. The color-non-uniformity correction value is calculated in a similar manner for the range of 50%<Gb<0% as well.

Figure 6:
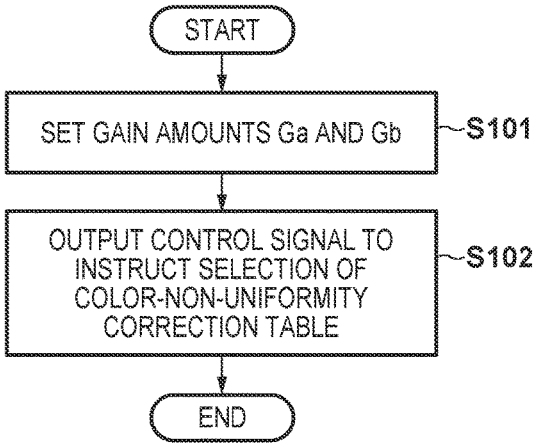
FIG. 6 is a flowchart for explaining control of gain amounts and color-non-uniformity correction values.

Control of gain amounts and color-non-uniformity correction values will be explained with reference to the flowchart of FIG. 6. The control unit 105 sets the gain amount Ga of the first subframe image and the gain amount Gb of the second subframe image (S101). Next, the control unit 105 outputs a control signal to instruct selection of a color-non-uniformity correction table corresponding to the gain amounts Ga and Gb (S102). According to the control signal, in the color-non-uniformity correction unit 104, the selection unit 303 selects a color-non-uniformity correction table, and the processing unit 301 performs color-non-uniformity correction processing using the selected color-non-uniformity correction table.

The gain amounts set by the control unit 105 can be either values set by the user as the adjustment parameters of the reduction degree of a motion blur or values calculated in accordance with the presence/absence or magnitude of a motion between frames. When user set values are used as the gain amounts, the control unit 105 performs the processing shown in FIG. 6 once at the time of activation of the image processing apparatus 100 or when a user set value is changed. On the other hand, when the gain amounts are calculated based on the motion between frames, the control unit 105 executes the processing shown in FIG. 6 every time a gain amount is changed.

[Double Speed Drive and Color-Non-Uniformity Correction Processing]

Figure 4A:
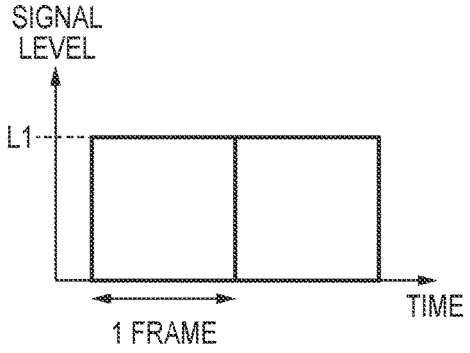
FIGS. 4A to 4C and 5A to 5D are views for explaining the relationship between double speed drive and color-non-uniformity correction processing.
Figure 4B:
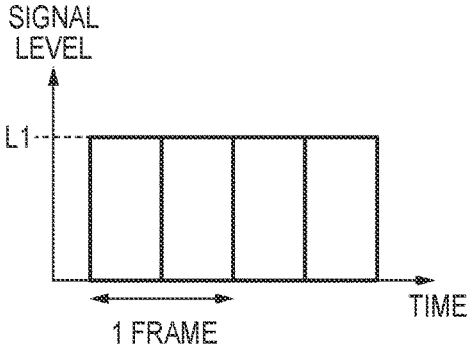
Figure 4C:
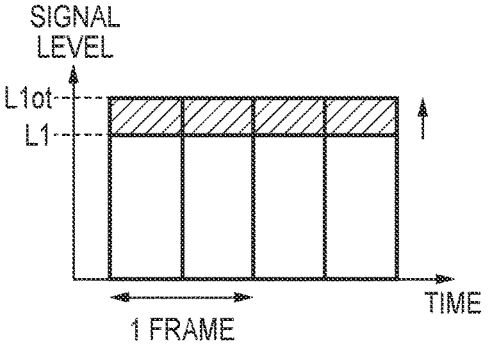

The relationship between double speed drive and color-non-uniformity correction processing will be described with reference to FIGS. 4A to 4C and 5A to 5D. In these drawings, the abscissa represents the time (frame time), and the ordinate represents the signal level of a pixel at certain coordinates. FIG. 4A shows a state in which the signal level is L1 continuously in two frame periods. FIG. 4B shows a state in which the frame rate shown in FIG. 4A is doubled. Since the frame rate is simply doubled, the signal level does not change. FIG. 4C shows a state in which the signals shown in FIG. 4B have undergone color-non-uniformity correction processing. The signal level L1 before correction changes to a signal level L1*ot* after correction.

FIG. 4C shows color-non-uniformity correction processing of signals at the same coordinates and same signal level. Hence, the signal level after correction is the same signal level L1*ot* in the four subframe periods shown in FIG. 4C. In the periods shown in FIG. 4C, the signal level does not change between the subframes, and desirable color-non-uniformity correction processing according to the color-non-uniformity correction value is performed without the influence of the response speed.

Figure 5A:
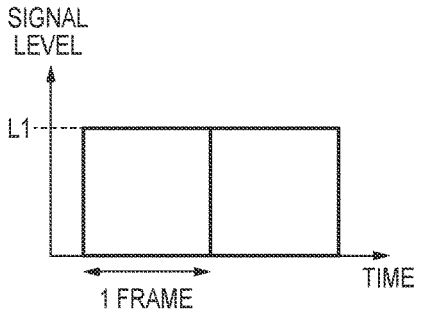
Figure 5B:
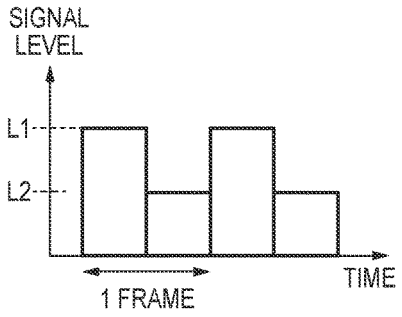
Figure 5C:
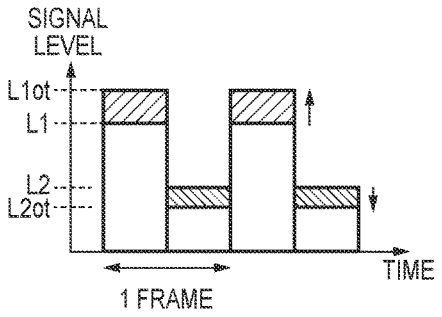

FIG. 5A shows a state in which the image signal level is L1 continuously in two frame periods, like FIG. 4A. FIG. 5B shows a state in which after the frame rate shown in FIG. 5A is doubled, the signal level of each second subframe image is adjusted to L2 by the image generation unit 103. FIG. 5C shows a state in which the signals shown in FIG. 5B have undergone color-non-uniformity correction processing. FIG. 5C shows a state in which the signal level L1 of each first subframe image is corrected to L1*ot*, and the signal level L2 of each second subframe image is corrected to L2*ot*. If the response speed is sufficiently high, the liquid crystal panel is driven in accordance with the signal levels shown in FIG. 5C, and desirable color-non-uniformity correction processing according to a color-non-uniformity correction value suitable for each signal level is performed.

Figure 5D:
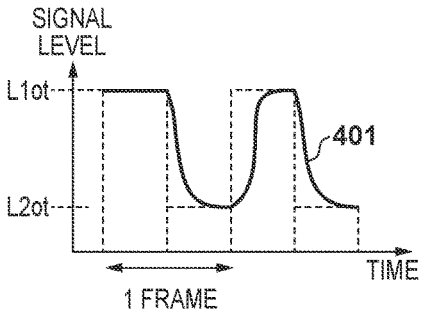

FIG. 5D schematically shows a transition 401 of signal levels influenced by the response speed in a case in which the response speed is not sufficiently high, and the liquid crystal panel is driven in accordance with the signal levels L1*ot* and L2*ot*. Because of the influence of the response speed, a delay occurs with respect to the ideal signal level transition shown in FIG. 5C. Since the response speed changes in accordance with the signal level transition between the subframes, the degree of influence of the response speed changes in accordance with the lightness adjustment degrees of the light image and the dark image and the color-non-uniformity correction value. In other words, the deviation from the ideal signal level changes in accordance with the signal level or display position, and the image quality degrades as a result.

On the other hand, according to the above-described control of gain amounts and color-non-uniformity correction values, color-non-uniformity correction processing is performed by referring to the color-non-uniformity correction table corresponding to the lightness adjustment degrees of the light image and the dark image. Hence, color-non-uniformity correction processing of reducing the influence of the response speed can be implemented. It is therefore possible to reduce unnaturalness of a motion of an object and reduce color non-uniformity caused by the response speed of the liquid crystal panel by light and dark display.

The signal level may be replaced with the tone value or density value of each color or a light amount. Frame rate doubling has been exemplified above. However, the present invention is not limited to this, and the frame rate may be N×(N≥2). The present invention is also applicable to a case in which the image signal levels of the preceding frame and the current frame are weighted and averaged or a method of generating a predicted image by detecting a motion vector between frames and inserting the predicted image into one subframe. This is particularly effective when the change between frames is small, or the moving amount of an object is small. The present invention is also applicable to a case in which the spatial frequency components or color components of an image are time-divisionally displayed.

[Color-Non-Uniformity Correction Table]

The color-non-uniformity correction table shown in FIG. 2 will be described in detail. As described above, the color-non-uniformity correction table is, for example, a table with a 3D lookup table format that stores color-non-uniformity correction values in correspondence with coordinates sampled in the horizontal and vertical directions for each of the plurality of reference signal levels 201 to 205.

When there exist the five reference signal levels 201 to 205, as shown in FIG. 2, the reference signal level 201 is set to the maximum signal level (for example, 100%) input to the color-non-uniformity correction unit 104 or a signal level close to it. The reference signal level 205 is set to the minimum signal level (for example, 0%) input to the color-non-uniformity correction unit 104 or a signal level close to it. The reference signal levels 202 to 204 are set to signal levels (for example, 75%, 50%, and 25%) that, for example, almost uniformly divide the signal level between the reference signal levels 201 and 205.

When the gain amount Ga of the first subframe image in the image generation unit 103 is 100%, and the gain amount Gb of the second subframe image is 50% at maximum, the signal level that the second subframe image input to the color-non-uniformity correction unit 104 can take ranges from 0% to 50%. In this case, the reference signal level 202 of the color-non-uniformity correction table is set to 50%, and the reference signal levels 203 and 204 are set to signal levels (for example, 32% and 16%) that, for example, almost uniformly divide the signal level between the reference signal levels 202 and 205. With such settings, a color-non-uniformity correction table that more finely stores color-non-uniformity correction values for the dark image can be obtained without increasing the memory capacity of the storage unit 302 that stores the color-non-uniformity correction table, and the correction accuracy of color-non-uniformity correction processing for the dark image can be improved.

Note that the reference signal levels need not always be divided uniformly and may be distributed so as to raise the interpolation accuracy in accordance with the change in the color-non-uniformity correction value. The number of reference signal levels is not limited to five, as a matter of course, and is set to a number according to the necessary color-non-uniformity correction accuracy.

As described above, the color-non-uniformity correction value can accurately flexibly be changed by applying a different color-non-uniformity correction value on a subframe basis. When light and dark display is performed after frame rate doubling, color-non-uniformity correction values considering correction values for improving the response speed can be set in advance. It is therefore possible to reduce unnaturalness of a motion of an object and reduce color non-uniformity caused by the response speed by light and dark display. In addition, it is possible to reduce the influence of the response speed without performing overdrive processing that needs a frame memory to store the image of the preceding frame and increasing the memory capacity.

Modification of Embodiment

An example in which a different color-non-uniformity correction value is applied on a subframe basis will be described below. That is, an arrangement capable of applying different color-non-uniformity correction values to first and second subframes when performing frame rate doubling and then light and dark display is employed, and the color-non-uniformity correction value of each subframe is changed in accordance with the lightness adjustment degrees of a light image and a dark image in light and dark display.

For color non-uniformity observed due to adjustment of the lightness of the second subframe image, the color-non-uniformity correction value applied to the second subframe image is adjusted. For color non-uniformity observed due to adjustment of the lightness of the first subframe image, the color-non-uniformity correction value applied to the first subframe image is adjusted.

When using a color-non-uniformity correction table, for example, a color-non-uniformity correction table generated so as to reduce color non-uniformity is applied to the second subframe in a state in which the lightness of the second subframe image is adjusted. A color-non-uniformity correction table to be applied to the first subframe image may be adjusted.

When performing frame rate doubling and then light and dark display, the signal level of one subframe can be estimated in accordance with the signal level of the other subframe. Especially when light and dark display is done by multiplication of gain amounts, the signal level of one subframe is known relative to the signal level of the other subframe. In this case, for example, a color-non-uniformity correction table considering correction values for improving the response speed based on the signal level of the immediately preceding subframe can be set as the color-non-uniformity correction table to be applied to the second subframe. The description has been made concerning the second subframe. However, this also applies to the first subframe.

Second Embodiment

An image processing apparatus, an image processing method, and an image display apparatus according to the second embodiment of the present invention will be described below. Note that the same reference numerals as in the first embodiment denote the same parts in the second embodiment, and a detailed description thereof may be omitted.

Figure 7:
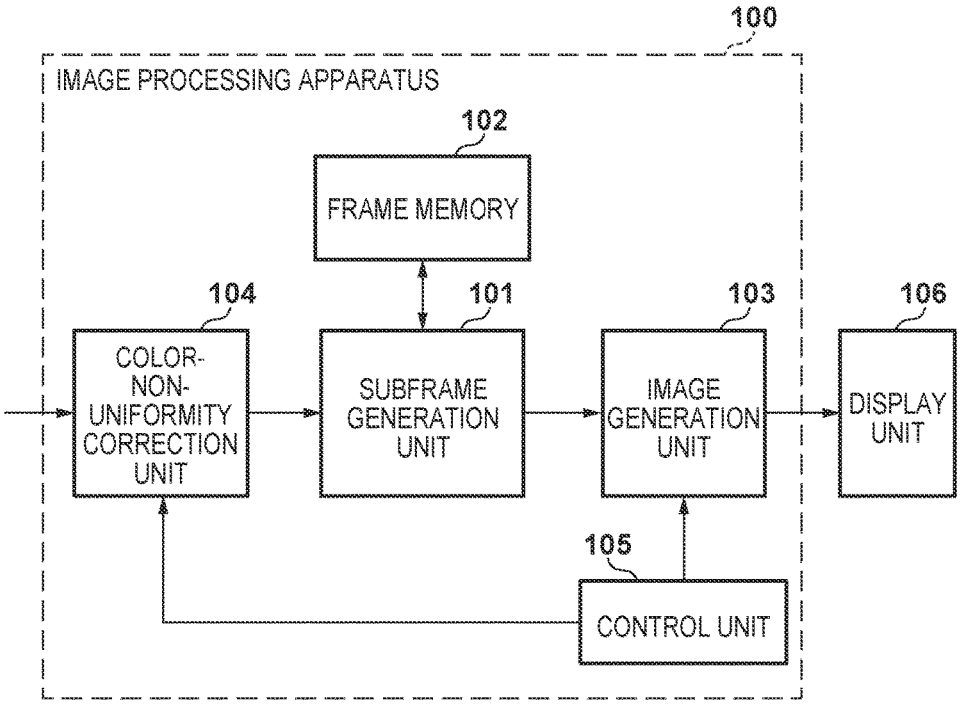
FIG. 7 is a block diagram showing the arrangement of an image display apparatus including an image processing apparatus according to the second embodiment.

The block diagram of FIG. 7 shows the arrangement of an image display apparatus including an image processing apparatus 100 according to the second embodiment. In the image processing apparatus 100 according to the second embodiment, a color-non-uniformity correction unit 104, a subframe generation unit 101, and an image generation unit 103 perform processing in this order, unlike the image processing apparatus 100 shown in FIG. 1.

In the image processing apparatus 100 according to the second embodiment, the color-non-uniformity correction unit 104 performs color-non-uniformity correction processing for each input frame image. The subframe generation unit 101, for example, doubles the frame rate to generate a first subframe image SF[i] and a second subframe image SF[i+1]. The image generation unit 103 adjusts the lightness of each subframe image to reduce a motion blur. A control unit 105 controls color-non-uniformity correction values in accordance with the lightness adjustment degree, as in the first embodiment.

As described above, the image processing apparatus 100 according to the second embodiment that performs color-non-uniformity correction processing and then light and dark display can also reduce unnaturalness of a motion of an object and reduce color non-uniformity caused by the response speed of the liquid crystal panel by light and dark display as in the first embodiment.

An example in which the color-non-uniformity correction table is used for color-non-uniformity correction processing has been described above. However, an arrangement for calculating a color-non-uniformity correction value using a function representing color non-uniformity of a liquid crystal panel may be used as long as the color-non-uniformity correction value can be changed in accordance with the lightness adjustment degree of light and dark display. Another correction processing such as overdrive correction processing for improving the response speed of the liquid crystal panel and the arrangement of the first or second embodiment may be combined.

An example in which the present invention is applied to a display apparatus including a liquid crystal panel as a hold-type display device has been described above. For a display apparatus such as a projector, a DLP (Digital Light Processing) method using a digital micro-mirror device (DMD) exists. Such a display apparatus turns on/off light projection by the DMD, and continuously projects the same image during one frame. In other words, the DMD is a hold-type display device. Hence, the present invention can effectively be applied to a projector of the DLP method. In addition, the present invention can reduce unnaturalness of a motion of an object and reduce color non-uniformity caused by the response speed not only on a hold-type display device but also on a display apparatus and is applicable to an impulse-type display device.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)®), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-060019 filed Mar. 23, 2015 which is hereby incorporated by reference herein in its entirety.

What is claimed is:

1. An image processing apparatus for outputting an image to a display device, the apparatus comprising:

one or more processors; and a memory having stored thereon instructions which, when executed by the one or more processors, cause the image processing apparatus to:

generate a plurality of sub-frame images from an input frame image;

adjust lightness of one or more sub-frame images included in the plurality of sub-frame images to generate a light image and a dark image using an adjustment degree of the lightness, wherein the dark image is not brighter than the light image;

set a color-non-uniformity correction table among a plurality of color-non-uniformity correction tables based on the adjustment degree used for adjusting the light image and the dark image; and perform color-non-uniformity correction processing on the light image and the dark image using a correction value obtained by referencing the set color-non-uniformity correction table to reduce color non-uniformity of the display device.

2. The apparatus according to claim 1, wherein the instructions, when executed by the one or more processors, further cause the image processing apparatus to perform an adjustment for brightening the lightness of one or more sub-frame images included in the plurality of sub-frame images to generate the light image, and perform an adjustment for darkening the lightness of a sub-frame image different from the one or more sub-frame images than lightness of the light image to generate the dark image.

3. The apparatus according to claim 1, wherein the instructions, when executed by the one or more processors, further cause the image processing apparatus to output the dark image after outputting the light image.

4. The apparatus according to claim 1, wherein the instructions, when executed by the one or more processors, further cause the image processing apparatus to obtain the correction value by referencing the set color-non-uniformity correction table based on a signal level of a pixel of interest, and a display position of the pixel of interest in the display device.

5. The apparatus according to claim 1, wherein the instructions, when executed by the one or more processors, further cause the image processing apparatus to set the adjustment degree.

6. The apparatus according to claim 5, wherein the instructions, when executed by the one or more processors, further cause the image processing apparatus to set the adjustment degree in accordance with a user's designation.

7. The apparatus according to claim 5, wherein the instructions, when executed by the one or more processors, further cause the image processing apparatus to set the adjustment degree in accordance with presence/absence of a motion between frames and/or magnitude of a motion between frames.

8. The apparatus according to claim 1, wherein the instructions, when executed by the one or more processors, further cause the image processing apparatus to:

adjust lightness of one or more sub-frame images included in the plurality of sub-frame images to generate the light image using a first adjustment degree of the adjustment degree and the dark image using a second adjustment degree of the adjustment degree;

set the color-non-uniformity correction table among a plurality of color-non-uniformity correction tables based on a combination of the first adjustment degree and the second adjustment degree; and perform the color-non-uniformity correction processing on the light image and the dark image using the correction value to reduce color non-uniformity of the display device.

9. The apparatus according to claim 1, wherein the instructions, when executed by the one or more processors, further cause the image processing apparatus to:

set the color-non-uniformity correction table by selecting the color-non-uniformity correction table based on the adjustment degree; and perform color-non-uniformity correction processing on the light image and the dark image to reduce color non-uniformity of the display device using a correction value determined based on a correction value obtained by referencing the selected color-non-uniformity correction table from the plurality of color-non-uniformity correction tables.

10. The apparatus according to claim 1, wherein the adjustment degree includes a first gain amount for generating the light image and a second gain amount for generating the dark image.

11. The apparatus according to claim 1, wherein the color-non-uniformity correction table is a three-dimensional lookup table in which a correction value corresponding to a position in the display device is stored for each of a plurality of reference signals, wherein the instructions, when executed by the one or more processors, further cause the image processing apparatus to adjust the plurality of reference signals of the set color-non-uniformity correction table based on a maximum signal level and a minimum signal level after the adjusting the lightness, and wherein the color-non-uniformity correction processing is performed on the light image and the dark image using the adjusted color-non-uniformity correction table.

12. An image processing apparatus for outputting an image to a display device, the apparatus comprising:

one or more processors; and a memory having stored thereon instructions which, when executed by the one or more processors, cause the image processing apparatus to:

input an image;

set a color-non-uniformity correction table among a plurality of color-non-uniformity correction tables based on an adjustment degree used for generating a light image and a dark image that is not brighter than the light image;

perform color-non-uniformity correction processing on the image using a correction value obtained by referencing the set color-non-uniformity correction table to reduce color non-uniformity of the display device;

generate a plurality of sub-frame images from one frame image on which the color-non-uniformity correction processing is performed; and adjust lightness of one or more sub-frame images included in the plurality of sub-frame images, using the adjustment degree, to generate the light image and the dark image.

13. An image display apparatus comprising:

a hold-type display device; and an image processing apparatus, wherein the image processing apparatus comprises:

one or more processors, and a memory having stored thereon instructions which, when executed by the one or more processors, cause the image processing apparatus to:

generate a plurality of sub-frame images from an input frame image;

adjust lightness of one or more sub-frame images included in the plurality of sub-frame images to generate a light image and a dark image using an adjustment degree of the lightness, wherein the dark image is not brighter than the light image;

set a color-non-uniformity correction table among a plurality of color-non-uniformity correction tables based on the adjustment degree used for adjusting the light image and the dark image; and perform color-non-uniformity correction processing on the light image and the dark image using a correction value obtained by referencing the set color-non-uniformity correction table to reduce color non-uniformity of the hold-type display device.

14. An image display apparatus comprising:

a hold-type display device; and an image processing apparatus, wherein the image processing apparatus comprises:

one or more processors, and a memory having stored thereon instructions which, when executed by the one or more processors, cause the image processing apparatus to:

input an image;

set a color-non-uniformity correction table among a plurality of color-non-uniformity correction tables based on an adjustment degree used for generating a light image and a dark image that is not brighter than the light image;

perform color-non-uniformity correction processing on the image using a correction value obtained by referencing the color-non-uniformity correction table to reduce color non-uniformity of the display device;

generate a plurality of sub-frame images from one frame image on which the color-non-uniformity correction processing is performed; and adjust lightness of one or more sub-frame images included in the plurality of sub-frame images, using the adjustment degree, to generate the light image and the dark image.

15. An image processing method of outputting an image to a display device, the method comprising:

using a processor to perform:

generating a plurality of sub-frame images from an input frame image;

adjusting lightness of one or more sub-frame images included in the plurality of sub-frame images to generate a light image and a dark image using an adjustment degree of the lightness, wherein the dark image is not brighter than the light image;

setting a color-non-uniformity correction table among a plurality of color-non-uniformity correction tables based on the adjustment degree used for adjusting the light image and the dark image; and performing color-non-uniformity correction processing on the light image and the dark image using a correction value obtained by referencing the set color-non-uniformity correction table to reduce color non-uniformity of the display device.

16. An image processing method of outputting an image to a display device, the method comprising:

using a processor to perform:

inputting an image;

setting a color-non-uniformity correction table among a plurality of color-non-uniformity correction tables based on an adjustment degree used for generating a light image and a dark image that is not brighter than the light image;

performing color-non-uniformity correction processing on the image using a correction value obtained by referencing the color-non-uniformity correction table to reduce color non-uniformity of the display device;

generating a plurality of sub-frame images from one frame image on which the color-non-uniformity correction processing is performed; and adjusting lightness of one or more sub-frame images included in the plurality of sub-frame images, using the adjustment degree, to generate the light image and the dark image.

17. A non-transitory computer readable medium storing a computer-executable program for causing a computer to perform an image processing method of outputting an image to a display device, the method comprising:

generating a plurality of sub-frame images from an input frame image;

adjusting lightness of one or more sub-frame images included in the plurality of sub-frame images to generate a light image and a dark image using an adjustment degree of the lightness, wherein the dark image is not brighter than the light image;

setting a color-non-uniformity correction table among a plurality of color-non-uniformity correction tables based on the adjustment degree used for adjusting the light image and the dark image; and performing color-non-uniformity correction processing on the light image and the dark image using a correction value obtained by referencing the set color-non-uniformity correction table to reduce color non-uniformity of the display device.

18. A non-transitory computer readable medium storing a computer-executable program for causing a computer to perform an image processing method of outputting an image to a display device, the method comprising:

inputting an image;

setting a color-non-uniformity correction table among a plurality of color-non-uniformity correction tables based on an adjustment degree used for generating a light image and a dark image that is not brighter than the light image;

performing color-non-uniformity correction processing on the image using a correction value obtained by referencing the color-non-uniformity correction table to reduce color non-uniformity of the display device;

generating a plurality of sub-frame images from one frame image on which the color-non-uniformity correction processing is performed; and adjusting lightness of one or more sub-frame images included in the plurality of sub-frame images, using the adjustment degree, to generate the light image and the dark image.

* * * * *